United States Patent [19]

Bourgeois

[11] 4,090,274

[45] May 23, 1978

[54] GRAVITY DOOR CLOSER

[75] Inventor: Jack Bourgeois, Galesburg, Ill.

[73] Assignee: Admiral Corporation, Schaumburg, Ill.

[21] Appl. No.: 752,651

[22] Filed: Dec. 20, 1976

[51] Int. Cl.[2] ..... E05F 1/06

[52] U.S. Cl. ..... 16/153; 312/319

[58] Field of Search ..... 16/153, 152, 154, 155, 16/156; 312/319, 138 R, 138 A; 49/239

[56] References Cited

U.S. PATENT DOCUMENTS

| | | | |
|---|---|---|---|
| 3,378,881 | 4/1968 | Hentzl et al. | 16/153 |
| 3,398,487 | 8/1968 | Matyas | 16/153 X |
| 3,628,845 | 12/1971 | Grimm | 16/153 X |
| 3,648,327 | 3/1972 | Edens | 16/153 |
| 3,722,031 | 3/1973 | Bourgeois | 16/153 |

*Primary Examiner*—James Kee Chi

[57] ABSTRACT

A gravity door closer for a refrigerated cabinet having a storage area to which access is gained through a door pivotable between an open position and a closed position about a vertical axis defined by upper and lower hinge units wherein a pair of vertically telescoping journalled bushings have hubs respectively mounted in openings formed in the lower surface of the door and a bracket on the cabinet, the bushings including a plurality of intermeshing circumferentially spaced camlobes defined by converging side walls terminating at flat tip walls, the side walls interengaging in the closed position and a predetermined open position such that the weight of the door tends to cause the camlobes to bottom in the grooves therebetween to establish detent positions, the flat tip walls of the camlobes contacting providing infinite door positioning in a sector between said detent positions, the torque applied to the bushings tending to rotate the same in the openings being resisted by torque arms attached to the door and the bracket at locations spaced from the hubs thereby avoiding localized shearing of the material thereabout.

2 Claims, 6 Drawing Figures

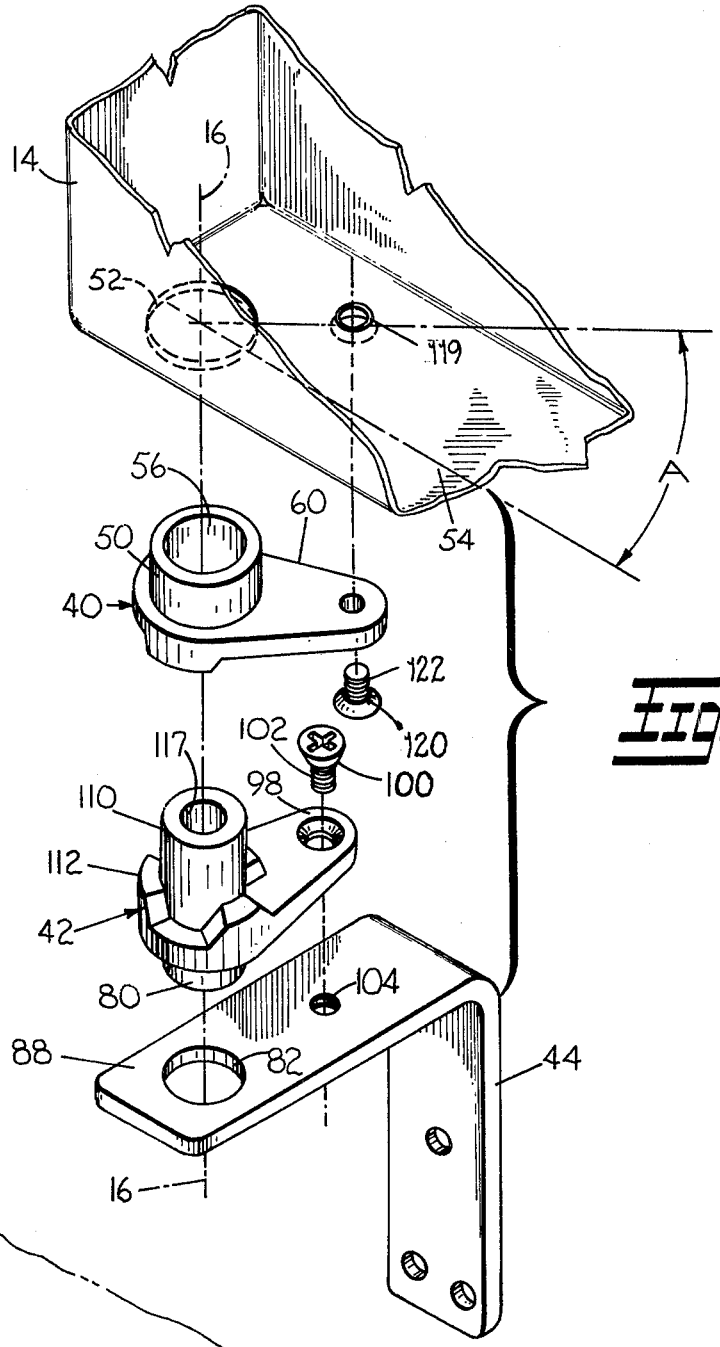
Fig. 6
Fig. 2
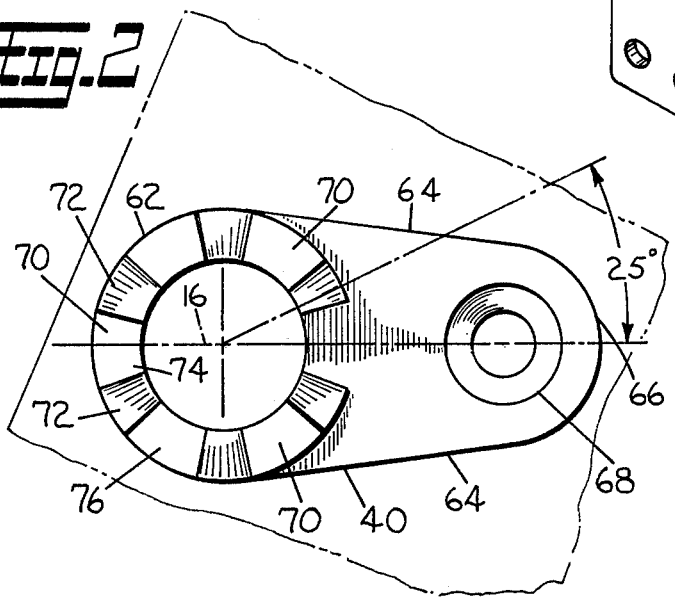
Fig. 3
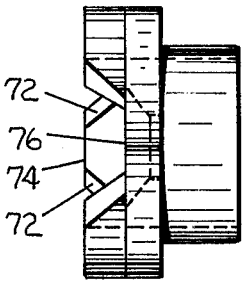

GRAVITY DOOR CLOSER

BACKGROUND OF THE INVENTION

The present invention relates to door closure devices and, in particular, a gravity door closer for providing open and closed detent positions with infinite door positioning therebetween.

In my prior U.S. Pat. No. 3,722,031 granted on Mar. 27, 1973, I provided a door closing and check device for refrigerators and freezers having positively checked open and closed positions wherein a stationary bushing mounted on the cabinet included four upwardly directed camlobes intermeshing with four complementary downwardly directed camlobes as a bushing mounted on the door and rotating within the stationary bushing. The camlobes of the two bushings were located relative to each other to cause the weight of the door to swing the same to its closed position from a partially open position as well as to check and maintain the door at successively wider open positions. The camlobes were in the form of circumferentially undulating surfaces such that only a plurality of distinct door positions were possible. The number of such positions depended on the number of camlobes.

With such a construction I found that it was not possible to attain any variation beyond these discrete positions. Moreover, the weight of the door caused a high loading engagement between the camlobes which tended to severely wear the same after cyclic operation. Therefore, in order to provide the requisite camlobe strength a metal construction, as opposed to a plastic construction, was mandated. However, the mounting of such bushings was by inserting a square shaped shank into a square punched hole in the lower thin sheet metal surface of the door and positioning a serrated hub in a circular opening in the cabinet bracket. The high torque applied to the camlobes of the bushings tended to rotate same within their respective frictional journals. In the case of the sheet metal door, it was found that the sides of the hubs or shanks would cause localized shearing of the surrounding metal and that ultimately the antirotation resistance thereof was destroyed. Similarly, the serrations between the bracket and the hub caused localized shearing and, same, after extended use, the hub became rotatable therewithin. This destroyed the necessary fixed angular positioning.

Another self-closing door closure device is shown in U.S. Pat. No. 3,628,845 (Grimm) issued on Dec. 21, 1971. This device likewise made use of a plurality of intermeshing camlobes in the lower hinge unit. However, the arrangement provided for offsets between the upper and lower hinge axes. The camlobes included converging straight side walls terminating with planar tips. The arrangement was such that two distinct self-closing forces were provided as the door moved from a fully detented open position to a self-biasing closed position. In other words, when the door had rotated from the open position until the camlobe tips contacted, a closing force of a first magnitude was provided. When the side walls interengaged a considerably greater closing force was established. This arrangement, however, likewise did not provide for infinite positioning between distinct detent positions. Moreover, the upper member of the device was pivotally mounted at a screw connection for alignment with a receptacle on the lower surface of the door while the lower member was contained on the cabinet bracket at a non-rotatable connection.

While somewhat tending to eliminate the problem of localized shearing at the lower surface, a supplemental receptacle was required which did not provide affirmative alignment of the upper bushing with respect thereto. The lower member was, as in my prior invention, subject to localized shearing and subsequent loosening within the connection such that the fixed detent positions were obviated.

The present invention overcomes the above limitations by providing a pair of telescoping bushings having intermeshing camlobes which provide discrete open and closed positions with infinite positions therebetween. The torque applied at the mountings is resisted by torque arms attached to the cabinet and the door at positions radially spaced from the hinge axis such that no rotation, however limited, is possible thereat tending to cause localized shearing deformation. Between the aforementioned detent positions, the camlobes are provided with interengaging planar walls to establish infinite positioning therebetween.

The above and other features of the present invention will be readily apparent to those skilled in the art, reference being made to the accompanying drawings illustrating a preferred embodiment in which:

BRIEF DESCRIPTION OF THE DRAWINGS

FIG. 2 is a bottom view of the upper hinge bushing with the door shown in dashed lines;

FIG. 3 is a side elevational view of the upper hinge bushing;

FIG. 6 is an exploded perspective view showing the gravity door closer in spaced relationship to the door and the cabinet bracket.

DESCRIPTION OF THE PREFERRED EMBODIMENT

Figure 4:
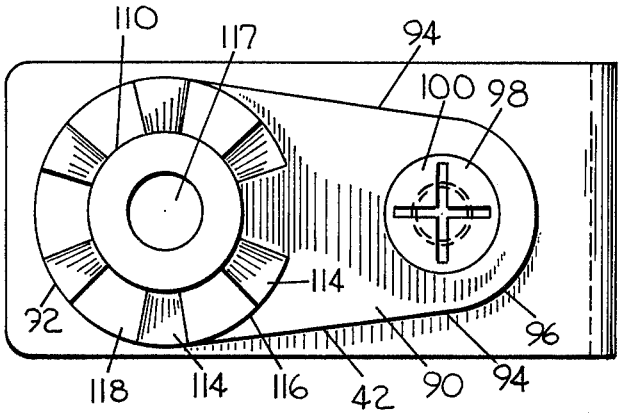
FIG. 4 is a top view of the lower hinge bushing showing the same mounted on the cabinet bracket.
Figure 5:
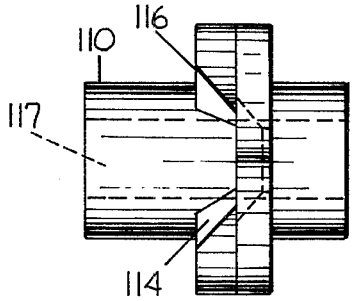
FIG. 5 is a side view of the lower hinge bushing.
Figure 1:
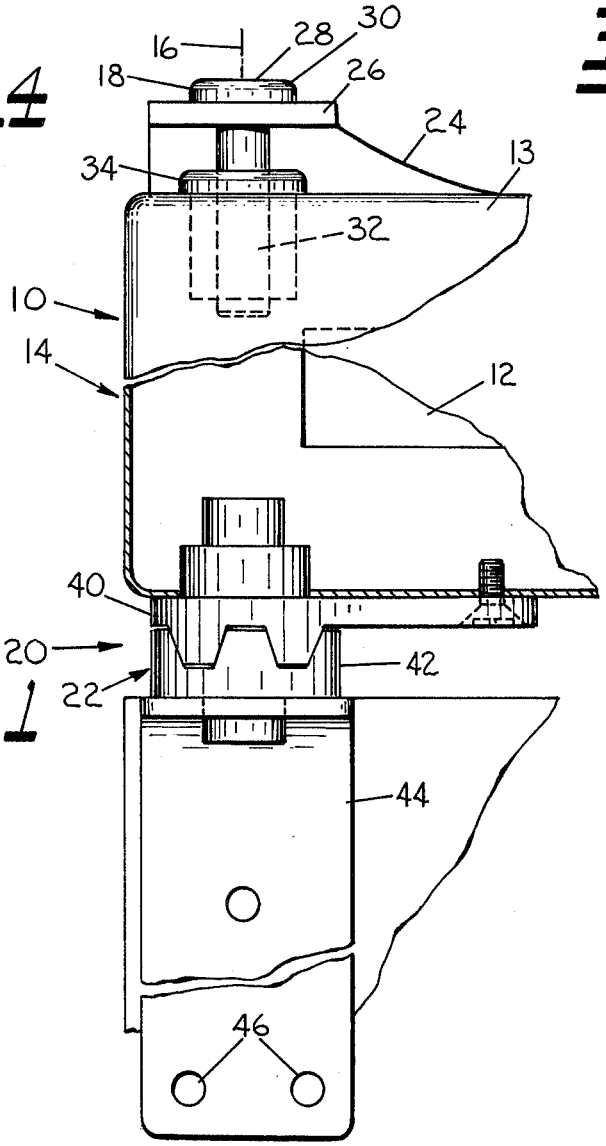
FIG. 1 is a partial front elevation view of a refrigerated cabinet showing a door mounted on the cabinet at upper and lower hinge units with the lower hinge unit including a gravity door closer made in accordance with the present invention.

Referring to FIG. 1 there is shown a refrigerated cabinet 10 such as a refrigerator, or a freezer either of which may contain single or multiple doors. The box like cabinet 10 includes an enclosure 12 having interior storage space 13 to which access is gained by means of a door 14 formed of a sheet metal construction. The door 14 is pivotable about a vertical hinge axis 16 between the illustrated closed position and an open position angularly spaced therefrom. The door 14 is provided with suitable gaskets for engaging the periphery of the storage space 13 to effect a seal therebetween. Pivotal movement between the open and closed position about the axis 16 is accommodated by an upper hinge unit 18, and a lower hinge unit 20 incorporating a gravity door closer 22 in accordance with the present invention.

The upper hinge unit 18 includes a bracket 24 mounted on the top surface of the enclosure 13 having a forwardly extending arm 26 which is apertured and through which an upper hinge pin 28 including a flanged head 30 and hinge pin 32 extends into a central opening in a bushing 34 retained in an opening in the upper surface of the door 14. The hinge pin 32 is of suitable length such that it can telescope relative to the bushing 34 as the door 14 moves vertically between rotated positions as hereinafter disclosed. The lower hinge unit 20 includes the aforementioned gravity door closer 22 comprising an upper hinge bushing 40 mounted on a lower surface of the door 14 and a lower hinge bushing 42 mounted on a generally L-shaped cabinet bracket 44 connected to a lower frontal portion of the cabinet by means of fasteners (not shown) threadly connected to the cabinet through openings 46 in the lower arm of bracket 44 (FIG. 1).

Referring to the remaining figures, the upper hinge bushing 40 includes an upper circular hub 50 which is telescopically received in a circular opening 52 at the bottom surface 54 of the door 14. The hub 50 includes a circular through hole 56 coaxial with axis 16 in assembly. A torque arm 60 is formed axially intermediate the bushing 40 and includes circular inner end 62 coaxial with the hub 50 terminating with a radially outwardly extending terminal section defined by tangential side walls 64 and a convex tip 66. The outer end of the arm 60 is drilled and countersunk as indicated at 68 to receive a mounting screw 120 having a threaded shank 122 which is threadably received in a threaded opening 119 formed at a like radial distance from the axis 16 and angularly spaced from the front surface of the door by an angle A. A plurality of downwardly projecting camlobes 70 are equally circumferentially formed around the hole 56 in the lower surface of inner end 62 concentric with axis 16. The camlobes 70 are defined by downwardly converging radial flat side walls 72 terminating with a horizontal flat tips 74. The camlobes 70 as mutually spaced by planar base walls 76. In the disclosed embodiment there are three such camlobes 70 which are spaced 120° apart and defined by planar walls having a span of about 38°, the side walls having a span of about 22°.

The lower hinge bushing 42 includes a downwardly projecting circular hub 80 which is received in a circular opening 82 formed in outwardly projecting arm 88 of the bracket 44. The opening 82 is coaxial with axis 16 inasmuch as the hub in assembly is also coaxial therewith. A torque arm 90 is formed axially intermediate the bushing 42 above the hub 80 and includes a circular inner end 92 coaxial with axis 16 terminating with an outer end defined by converging tangential side walls 94 and convex tip 96. The outer end is formed with a counter sunk hole 98 which is adapted to receive a mounting screw 100 having a threaded shank 102 threaded into a threaded opening 104 formed in an inner portion of the arm 88 radially spaced from the axis 16 identical to the radial spacing of the hole 98. The upper surface of the lower bushing 42 is formed with an upwardly projecting cylindrical hinge pin 110 having a diameter slightly less than the opening 56 in the upper hinge unit 40 so as to be rotatably slidably journalled thereby for vertical and rotative movement as the door pivots about the axis 16 relative to the cabinet bracket 44. The hinge pin 110 is outwardly surrounded by a plurality of upwardly projecting equally circumferentially spaced camlobes 112. The lobes 112 are identical to the camlobes in the upper hinge member 40 and include converging radial side walls 114 terminating with a horizontal flat tips 116 and spaced by planar base walls 118. The lower bushing 42 includes a hole 117 coaxial with the pin 110 and hub 80.

In assembled relation, with the bushings secured to the respective members, the cams interengage in discrete angular positions to establish detented open and closed positions.

Because the arm of bushing 40 is offset 65° (90°-A), in the closed position, the tips do not bottom out with respect to each other. Rather they remain in camming sliding engagement by interengagement of their side walls for an additional 5° of closing movement. The weight of the door acting on these surfaces provides a positive closing force urging the door 14 into greater closing engagement with the periphery of the compartment 12. If the door is pivoted about the axis 16 from the closed position, the side walls of the upper bushing 40 ride upwardly along corresponding side walls of the lower bushing 42. This vertically raises the door 14 as accommodated by the telescoping of the pin 110 of bushing 42 in the hole 56 of bushing 40. During this initial pivoting the door is in a self-closing mode with respect to the closed detent position. However, when the tips interengage, the horizontal planar surfaces provide a sector of infinitely positioning for the door without any self-closing forces being imposed thereon. However, as the tips disengage one another and the side walls reengage, the side walls of the upper camlobes 70 start to slide down side walls of the lower bushing camlobes and the weight of the door will cause the same to bottom out in an open detented position. Vertical downward movement again is accommodated by the pin 110 and hub 50 in the door closure 22 and the pin and bushing connection in the upper hinge unit.

In order to provide the requisite cyclic strength required for refrigerator and freezer applications, it is necessary to provide a selflubricating wear resistant material selection for the door closure. I have found that a sintered metal comprising 4% nickel steel which is case hardened and oil impregnated will provide the requisite durability characteristics. However, inasmuch as this is an extremely hard and shear resistant material, any tendency of the hubs to rotate within the mating openings would cause localized shearing of the adjacent sheet metal. Accordingly, I have provided the aforementioned torque arms 90 and 60. By using the outer pin connections, torque developed during engagement of the side walls is translated into a resultant moment about the outer pin connection such that only compressive forces are generated at the interface between the hubs and the surrounding metal. Accordingly, local deformation thereof is prevented. Moreover, in the event the small amount of deformation should occur, this only slightly alters the location of the hinge axis and will not impair proper opening of the door.

While the above has been described with reference to three equally disposed projections, it is quite apparent that any desired combination thereof with intermittent slots could be used to achieve incremental infinite positioning with a plurality of detent positions. While sintered metal is provided herein because of durability characteristics, it is apparent that other metals or suitable plastics may also be substituted, but inasmuch the torque between the lobes may generate sufficient torque to locally deform the interface surfaces, the torque arms are nonetheless preferred.

Although only one form of the present invention has been shown and described, others will be readily apparent to those skilled in the art, therefore it is not intended to limit the scope of the invention by the embodiment selected for purposes of disclosure but only by the claims which follow.

What is claimed is:

1. A hinge device for a refrigerator door which is axially aligned with an upper hinge member to allow pivotal movement of said door about an axis, said hinge device comprising:

a first member having a hub section disposed in an opening in the door in alignment with said axis;

a second member having a hub section disposed in an opening on the cabinet of the refrigerator and aligned with said axis;

said hub section of said second member including a pin extending along said axis to be received within a hole in said hub section of said first member;

anti-torque means on each of said members extending radially from said axis to respectively connect said members to said door and said cabinet at locations thereon spaced from said axis to prevent rotational forces on said members generated during said pivotal movement of said door from being transmitted through said hub sections to said opening in said door and said cabinet;

said first and said second members including interengaging camlobes around said hub sections each of which include alternating raised and lowered horizontal flat surfaces and inclined surfaces therebetween;

adjacent said inclined surfaces of said first and said second members being in sliding contact when said door is in a closed position to provide a positive closing force to said door;

said adjacent inclined surfaces remaining in contact during said pivotal movement of said door from a closed position tending to raise said door until sliding contact between said raised horizontal flat surfaces of said camlobes respectively of said first and said second members is established; and said sliding contact between said horizontal flat surfaces of said camlobes being maintained throughout a predetermined range of angular positions of said door relative to said closed position without any force being generated by said hinge device tending to close said door.

2. A hinge device as set forth in claim 1 wherein said first and said second members are made from a sintered metal comprising 4% nickel steel which is case hardened and oil impregnated.

* * * * *